US007819244B2

(12) United States Patent
De Vesci

(10) Patent No.: US 7,819,244 B2
(45) Date of Patent: Oct. 26, 2010

(54) RECONSTITUTION PACKAGE

(75) Inventor: Tom De Vesci, London (GB)

(73) Assignee: Horticultural Coir Limited, London (GB)

( * ) Notice: Subject to any disclaimer, the term of this patent is extended or adjusted under 35 U.S.C. 154(b) by 605 days.

(21) Appl. No.: 10/483,200

(22) PCT Filed: Jul. 3, 2002

(86) PCT No.: PCT/GB02/03068

§ 371 (c)(1),
(2), (4) Date: Jun. 28, 2004

(87) PCT Pub. No.: WO03/004379

PCT Pub. Date: Jan. 16, 2003

(65) Prior Publication Data

US 2004/0232012 A1 Nov. 25, 2004

(30) Foreign Application Priority Data

Jul. 4, 2001 (GB) ..... 0116387.2

(51) Int. Cl.
*B65D 25/08* (2006.01)
*A01G 9/02* (2006.01)

(52) U.S. Cl. ..... 206/219; 47/65.8

(58) Field of Classification Search ..... 206/219, 206/221, 223, 568, 204, 423; 47/84, 65.5, 47/65.8; 383/41, 104, 120, 121.1
See application file for complete search history.

(56) References Cited

U.S. PATENT DOCUMENTS

| | | | | |
|---|---|---|---|---|
| 4,424,645 | A * | 1/1984 | Rannali | 47/65.8 |
| 4,512,463 | A * | 4/1985 | Ward | 206/216 |
| 4,680,207 | A * | 7/1987 | Murray | 428/35.2 |
| 4,787,511 | A * | 11/1988 | McIver | 206/219 |
| 6,048,100 | A * | 4/2000 | Thrall et al. | 383/86 |
| 6,076,967 | A | 6/2000 | Beaudette | |
| 6,176,394 | B1 * | 1/2001 | Shimko et al. | 222/92 |
| 6,189,260 | B1 * | 2/2001 | Kusey et al. | 47/9 |

FOREIGN PATENT DOCUMENTS

| | | |
|---|---|---|
| DE | 39 07 008 A1 | 9/1990 |
| EP | 0 052 526 A1 | 5/1982 |

(Continued)

OTHER PUBLICATIONS

International Search Report for PCT Counterpart Application No. PCT/GB02/03068, 3 pgs (Oct. 8, 2002).

(Continued)

*Primary Examiner*—J. Gregory Pickett
(74) *Attorney, Agent, or Firm*—Blakely, Sokoloff, Taylor & Zafman LLP

(57) ABSTRACT

A package (10) for a material which can be reconstituted by adding a liquid thereto comprises an expandable bag (12) for containing the material in its unreconstituted state. The bag has an opening (18) allowing liquid to be introduced into the package, and an opening (16) allowing the reconstituted material to be removed from the package, which may be one and the same opening. The openings may be reclosable, and may also be water-tight. The bag may be reinforced at its lower end, and can have a carrying handle at its upper end.

12 Claims, 3 Drawing Sheets

FOREIGN PATENT DOCUMENTS

| | | | | |
|---|---|---|---|---|
| EP | 0 132 484 | A2 | | 2/1985 |
| FR | 1 312 514 | A | | 12/1962 |
| FR | 1 357 757 | A | | 4/1964 |
| FR | 2 732 948 | A1 | | 10/1996 |
| GB | 2137609 | A | * | 10/1984 |
| WO | WO 02/20363 | A1 | | 3/2002 |
| WO | WO 02/26567 | A2 | | 4/2002 |

OTHER PUBLICATIONS

Patent Cooperation Treaty's Written Opinion for International application No. PCT/GB02/03068, 5 pgs. (Jun. 30, 2003).

PCT Notification of Transmittal of International Preliminary Examination Report for PCT Counterpart Application No. PCT/GB02/03068, 7 pgs. (Oct. 6, 2003).

* cited by examiner

RECONSTITUTION PACKAGE

This Application is a National Phase of International Application No. PCT/GBO2/03068, filed on Jul. 3, 2002, which claims priority from Great Britain Patent Application No. 0116387.2, filed on Jul. 4, 2001.

The present invention relates to a package, and more particularly to a package which allows a product contained therein to be reconstituted by the addition of a liquid such as water. The package finds particular application in the field of growing media.

The term "growing medium" is used herein to denote any medium in which plants can grow, and includes (but is not limited to) substances such as soil, sand, compost, peat and coir. Coir is a peat-free growing medium made from the pith of the coconut husk.

It is a characteristic of some growing media, and in particular coir, that they are relatively heavy when sufficiently moist to form a viable growing medium, but have relatively low intrinsic value. As a result, they are expensive to transport.

In order to circumvent this, coir in particular is normally shipped from its country of origin in partially desiccated compressed blocks or briquettes. These blocks are then reconstituted by adding water. This may be done, for example, at a commercial grower's establishment, or at a growing media merchant, who may also add fertilizers or the like to the coir.

In addition, the blocks are also sold to the domestic market, and the purchaser then reconstitutes the coir themselves at home. As an example, coir is typically sold in 650 g blocks, measuring around 20 cm by 10 cm by 5 cm (and thus with a volume of around 1 liter). The block is normally placed in a receptacle such as a bucket, to which water is added. The mixture is then agitated to mix the coir and the water until the coir is fully reconstituted. This will produce around nine liters of usable growing medium.

There are a number of drawbacks to this process. A container is required for mixing, which is in itself a time-consuming process. The process can be rather messy, both from the reconstituted coir and the dried coir, which is dusty. In addition, if not all of the reconstituted coir is used immediately, then the container (or another container) must be used to store the coir.

At least in its preferred embodiments, the invention seeks to overcome these drawbacks.

According to the invention, there is provided a reconstitution package for a material which can be reconstituted by adding a liquid thereto, comprising an expandable bag for containing the material in its unreconstituted state, said bag having an opening allowing liquid to be introduced into the package, and an opening allowing the reconstituted material to be removed from the package.

In a package of this type, the material (such as coir) is reconstituted inside the package. There is therefore less mess. The ability of the bag to expand allows the material to increase in volume as it is reconstituted.

Preferably, the openings are reclosable. This allows the package to be reclosed after some of the reconstituted material has been removed, and so there is no need to use all of the material at one time.

Two separate openings may be provided. Alternatively, a single opening may be provided for the introduction of liquid and the removal of reconstituted material. A package with a single opening can be easier to manufacture. In a preferred form, the opening(s) is (are) resealable and liquid-tight.

Preferably, the opening allowing liquid to be introduced into the package is of a size to allow insertion of the end of a hose. This facilitates the introduction of liquid into the container. It is further preferred for the opening allowing liquid to be introduced into the package to be provided with means to grip the end of a hose inserted thereinto, to reduce the risk of the hose accidentally falling out of the opening, which could lead to spillage.

The opening allowing the reconstituted material to be removed from the package can take any suitable form. However, it is preferred for the opening to take the form of an elongate opening extending along a face of the bag. This allows an end user to insert tools such as trowels into the package to remove the reconstituted material. To further facilitate this, it is preferred that the elongate opening extends across a face of the bag, or even around the entire circumference of said bag.

As the package must accommodate the material in its reconstituted form, it must have a sufficient volume to do so. The package could be supplied in such a state that it already has the appropriate volume; however, such a package occupies more space than necessary, and increases shipping costs. Thus, it is preferred for the package to be capable of expanding to accommodate the reconstituted material. In a preferred form, the bag of the package is pleated or otherwise folded in its unexpanded state. These pleats or folds allow the bag to increase in volume as the material is reconstituted.

Preferably, the bag is adapted to stand on an end, with the opening(s) being provided in the upper region of the bag. This facilitates both the reconstitution step, and the step of removing material from the package. It is further preferred for the lower end of the bag to be reinforced.

In a preferred form, the bag is provided with a carrying handle, to facilitate transport. As mentioned above, the material being reconstituted may expand to several times its original volume during reconstitution, and so it may be necessary for the bag to have a considerable height to accommodate the reconstituted material. This height may be greater than the distance between a user's hand and the ground when the user is walking, and so in a particular form, the handle is positioned below the opening allowing the reconstituted material to be removed from the package when the package is carried by the handle. This opening will be positioned at or near the top of the bag, to simplify removal of the material.

A preferred embodiment of the invention will now be described by way of example only and with reference to the accompanying drawings, in which.

Figure 1:
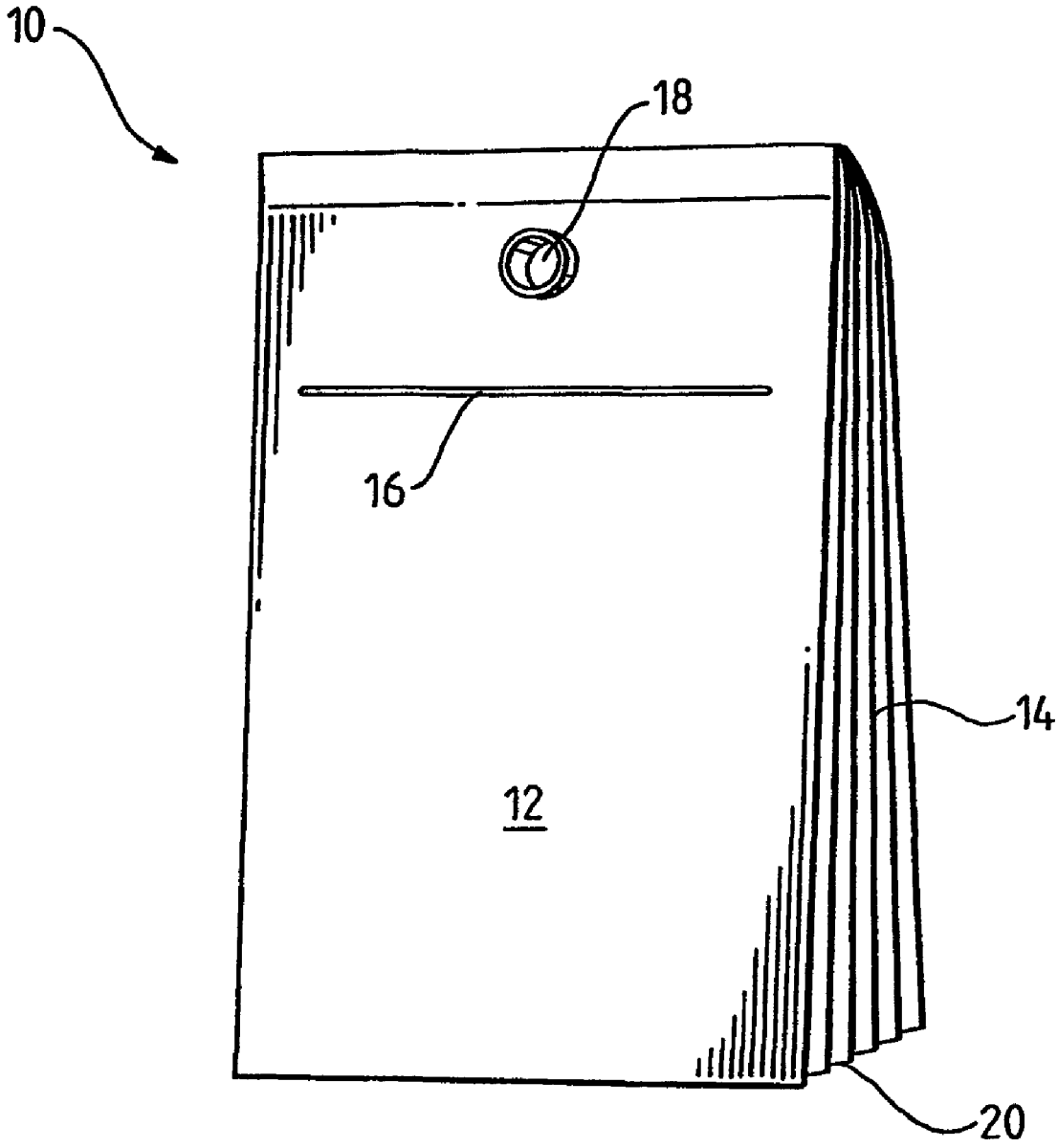
FIG. 1 is a schematic perspective view of the package.
Figure 2:
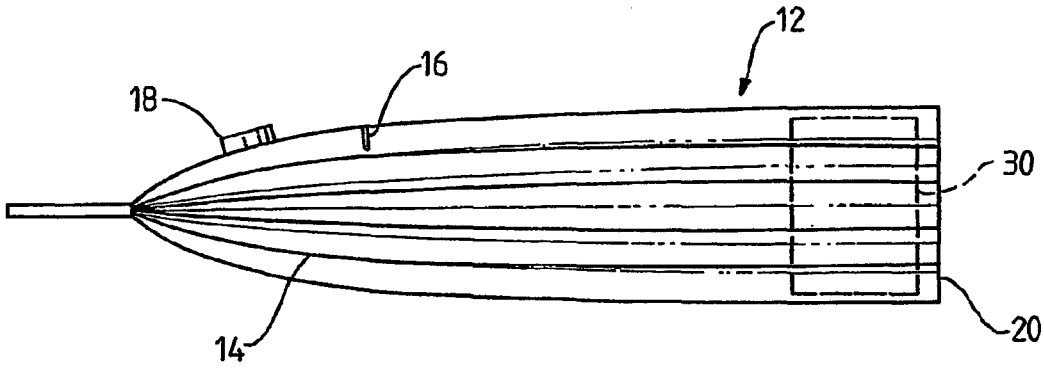
FIG. 2 is a schematic side view of the package before reconstitution.

As can be seen from the Figures, and in particular FIGS. 1 and 2, the package 10 is generally in the form of a bag 12 with pleated sides. This pleating 14 allows the bag to expand with its contents, and it will be appreciated that other arrangements allowing the bag 12 to expand in this way can also be used. The bag may be formed from any suitable sheet material which is sufficiently hardwearing and sufficiently flexible to allow the expansion and which will not react with or contaminate the contents.

Contained in the package as supplied, and shown schematically in phantom in FIG. 2, is a block 30 of compressed desiccated coir or the like, which may have fertilizers added.

Towards one end of the package 10 is a recloseable elongate opening 16, which may be of the "ZIP-LOC" type, or of any other suitable form. This opening may extend across the full width of one face of the package, or may have a smaller extent. In any case, the opening is preferably of sufficient length to allow an implement such as a trowel or a spade to be inserted into the package. The opening may be resealable and watertight.

A second opening 18 can also be provided, for the insertion of a hose or the like. The opening may be provided with means for grasping the end of the hose with sufficient force to prevent it from falling out. This may be in the form of a resilient piece of plastics material with slits in it, the slits forming an aperture through which the end of a hose can be inserted, although the skilled person will appreciate that any other similar form of gripper can be used. The opening may be closed by a screw cap (in a similar way to openings on cartons for milk and juice), or by any other suitable type of closure, and may again be resealable and water-tight.

The package is adapted to stand upright on one end 20, so that the openings 16, 18 are at the top. This can be achieved by making the package generally wedge-shaped (as shown), or by having a relatively heavy piece 22 of preferably plastics material at the base of the package 10. Of course, it is possible to use both approaches at once, and this may be preferred as it reinforces the lower end 20 of the package, which is more likely to suffer wear and tear.

Use of the package is as follows. A user will purchase the package 10 containing the compressed coir at a garden supply centre or the like, and will take it home.

Figure 3:
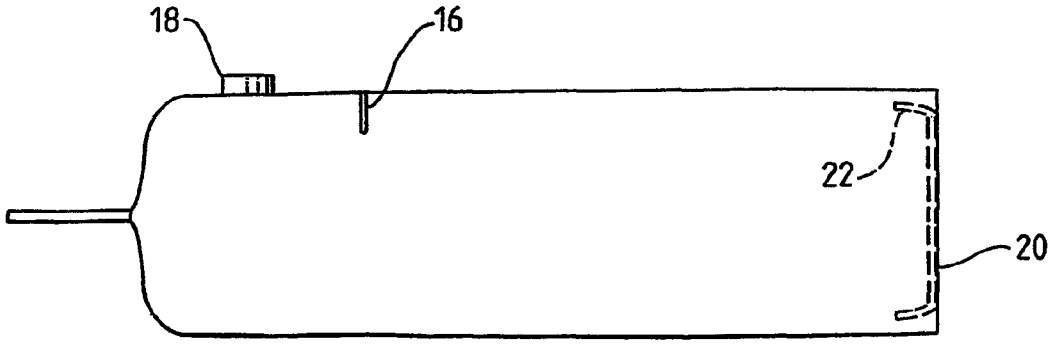
FIG. 3 is a schematic side view of the package after reconstitution.

When the user has the package at home, the second opening 18 is opened and the end of a hose or the like is inserted into it. Water is then added to the coir in the package 10 to reconstitute it. Once sufficient water has been added, the hose is removed and the opening 18 preferably closed. The addition of the water will force the package to expand, opening out the pleats 14 of the bag 12, as can be seen from FIG. 3. The compressed desiccated coir will then absorb the water and become reconstituted.

The user can then open the elongate opening 16 and insert a trowel or the like to remove the reconstituted coir from the package. Once the required amount of reconstituted coir has been removed, the package may be resealed.

It will be appreciated that the package has a number of advantages over the prior art. The procedure as a whole is cleaner; as the compressed desiccated coir is contained within the sealed package, there is no problem with it shedding dust, and in addition the reconstitution part of the process takes place in a sealed container. No additional containers are required for the reconstitution. In addition, the package as supplied is much lighter than a package of moist growing medium, and is thus easier for elderly or less robust persons to pick up and transport. Further, as the package is less bulky than a package of moist growing medium, shipping costs are reduced, and a retailer can stock more of the packages. The packages can be displayed indoors at garden supply centres or the like, which can help to increase sales during periods of bad weather when prospective purchasers are unwilling to be outdoors. Lastly, in its preferred form, the package is resealable, and so there is no need to use all of the coir at once.

It will also be appreciated by the skilled person that a number of variants to the preferred embodiment are possible. For example, the opening for the hose can be dispensed with, and water can be introduced into the package through the elongate opening, and a package of this type (with a single opening) may be preferred for manufacturing reasons, as it is easier to form a single opening than two 'separate openings. In addition, the elongate opening may extend the full circumference of the package, allowing easier access to the reconstituted coir.

A handle may be provided towards the top of the bag to simplify carriage. This could be in the form of a simple cutout in the sheets forming the bag, the edges of which are sealed to each other.

Figure 4:
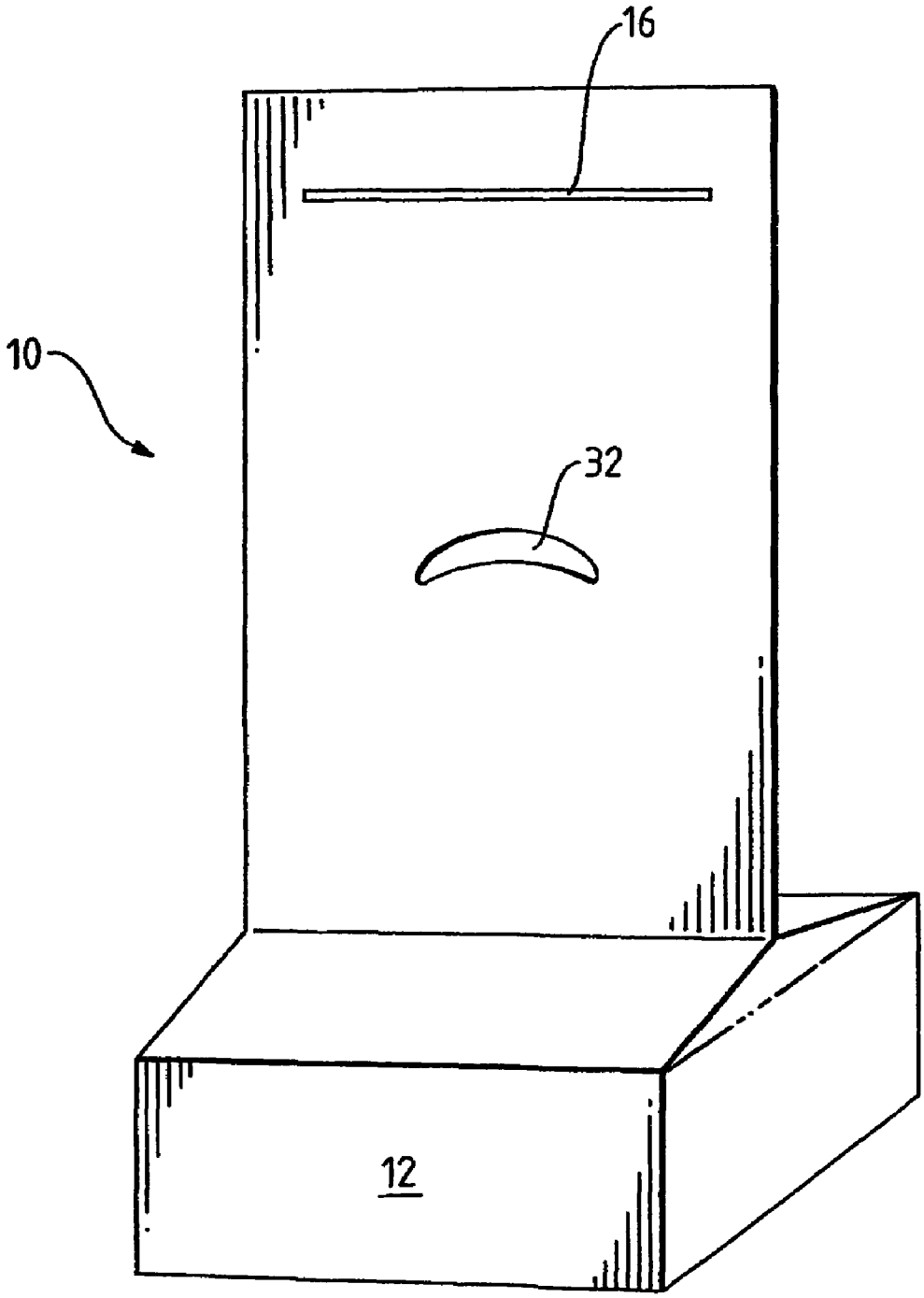
FIG. 4 is a schematic perspective view of an alternative form of the package.

It may be necessary to form the handle below the elongate opening; the bag will expand considerably as the material is reconstituted, and this may be require it to be of a height greater than the distance between a user's hand and the ground when the user is walking, in which case the handle must be positioned below the elongate opening. A package of this type is shown in FIG. 4. Here, the handle 32 is formed as a simple cutout through the front and back sheets of the bag, which are joined together when the material is in its unreconstituted state (as shown). As will be seen, the handle 32 is formed well below the elongate opening 16.

The handle and the opening may be arranged so that the user can insert an implement into the bag past the handle, to allow removal of the reconstituted material, or the handle may be formed such that the sheets forming the bag can be pulled apart to allow a user access to the full width of the bag.

Further, although the description has been in the context of a package for growing media, and in particular coir, it will be appreciated that the package can be used with other materials.

The invention claimed is:

1. A package, comprising:

a piece of compressed coir or a material containing compressed coir; and a flexible expandable bag having at least one expandable pleat, wherein the bag contains the compressed coir or a material containing compressed coir, wherein the compressed coir or the material containing compressed coir is expandable if a liquid is added to the compressed coir, wherein expanding the coir during reconstitution in the package expands the bag by several times an original volume of the bag by pressing against sides of the bag to form reconstituted coir or reconstituted material, wherein the bag has an opening to allow the liquid to be introduced into the package and the opening to allow the reconstituted coir or the reconstituted material to be removed from the package, wherein the package as supplied is compact, flexible, and light when compared to the package after reconstitution.

2. The package of claim 1, wherein the opening is recloseable.

3. The package of claim 2, wherein the opening is resealable and liquid-tight.

4. The package of claim 1, wherein the opening allowing liquid to be introduced into the package is of a size to allow insertion of the end of a hose.

5. The package of claim 4, wherein said opening allowing liquid to be introduced into the package is provided with means to grip the end of a hose inserted thereinto.

6. The package of claim 1, wherein the opening allowing the reconstituted material to be removed from the package is an elongate opening extending along a face of the bag.

7. The package of claim 6, wherein said elongate opening extends across substantially the full width of a face of the bag.

8. The package of claim 1, wherein said bag is pleated in its unexpanded state.

9. The package of claim 1, wherein said bag is adapted to stand on a lower end, with the opening being provided in the upper region of the bag.

10. The package of claim 9, wherein the lower end of the bag is reinforced.

11. The package of claim 1, wherein the bag is provided with a carrying handle.

12. The package of claim 11, wherein, when the package is carried by the handle, the handle is positioned below the opening allowing the reconstituted material to be removed from the package.

* * * * *